US006874199B2

(12) United States Patent
Simon et al.

(10) Patent No.: US 6,874,199 B2
(45) Date of Patent: Apr. 5, 2005

(54) PROTECTIVE COVER FOR GUIDANCE DEVICE FOR A FLEXIBLE-CURTAIN GOODS-HANDLING DOOR

(75) Inventors: Bernard Simon, Caluire et Cuire (FR); Antonello Lamarca, Pierre-Benite (FR)

(73) Assignee: Maviflex SA, Decines (FR)

( * ) Notice: Subject to any disclaimer, the term of this patent is extended or adjusted under 35 U.S.C. 154(b) by 0 days.

(21) Appl. No.: 10/428,993

(22) Filed: May 5, 2003

(65) Prior Publication Data

US 2003/0205341 A1 Nov. 6, 2003

(30) Foreign Application Priority Data

May 3, 2002 (FR) ..... 02 05550

(51) Int. Cl.[7] ..... A47H 15/00; E05D 15/00

(52) U.S. Cl. ..... 16/96 R; 16/DIG. 1; 16/90; 16/94 R; 160/272

(58) Field of Search ..... 16/96 R, 90, DIG. 1, 16/87 R, 94 R, 96 L, 87 B; 52/717.01, 717.03; 160/272; 49/414, 415, 416

(56) References Cited

U.S. PATENT DOCUMENTS 3,706,173 A * 12/1972 Taylor ..... 52/717.03
4,084,533 A * 4/1978 Boyer ..... 114/219
4,768,320 A * 9/1988 Weller ..... 52/211
4,947,614 A * 8/1990 Mayle ..... 52/718.01
5,117,892 A * 6/1992 Murray ..... 160/273.1
5,199,479 A * 4/1993 Kraeutler ..... 160/84.06
5,694,726 A * 12/1997 Wu ..... 52/287.1
6,065,525 A * 5/2000 Wells ..... 160/273.1
6,192,960 B1 2/2001 Simon
6,526,707 B2 * 3/2003 Tucker ..... 52/211
6,574,832 B1 * 6/2003 Boerger et al. ..... 16/90
6,647,681 B1 * 11/2003 Abbott ..... 52/288.1

FOREIGN PATENT DOCUMENTS

WO WO 9848139 A1 * 10/1998 ..... E06B/9/58
WO WO 153648 A1 * 7/2001 ..... E06B/9/58

* cited by examiner

*Primary Examiner*—Chuck Y. Mah
(74) *Attorney, Agent, or Firm*—Young & Thompson

(57) ABSTRACT

The protective cover according to the present invention comprises an internal space (30) designed to take the corresponding strap (8, 9) of a guidance device (6) and at least one continuous external face (26) forming the sliding face.

9 Claims, 6 Drawing Sheets

PROTECTIVE COVER FOR GUIDANCE DEVICE FOR A FLEXIBLE-CURTAIN GOODS-HANDLING DOOR

BACKGROUND OF THE INVENTION

The present invention relates to a cover for a guidance device for a flexible-curtain goods-handling door.

The guidance device consists basically of straps stretched between two end points built into each vertical jamb.

SUMMARY OF THE INVENTION

The object of the present invention is to improve the coefficient of sliding of, and the seal formed by, the straps forming the guidance device of the flexible-curtain goods-handling door.

The protective cover according to the present invention for a strap-type guidance device for a flexible-curtain goods-handling door comprises an internal space designed to take the corresponding strap of the guidance device and at least one continuous external face forming the sliding face.

The protective cover according to the present invention comprises a flexible lip extending along its full height.

The protective cover according to the present invention comprises a continuous face continued by two folded edges separated by a continuous vertical slit.

The protective cover according to the present invention comprises a flexible lip at the junction between the face and the folded edge.

The protective cover according to the present invention is made from plastics.

The protective cover according to the present invention is made from the same material and in the same color as the flexible curtain.

BRIEF DESCRIPTION OF THE DRAWINGS

The following description, which refers to the appended drawings, given by way of non-restrictive examples, will provide a clearer explanation of the invention, its features and the advantages it can provide.

DESCRIPTION OF THE PREFERRED EMBODIMENTS

Figure 1:
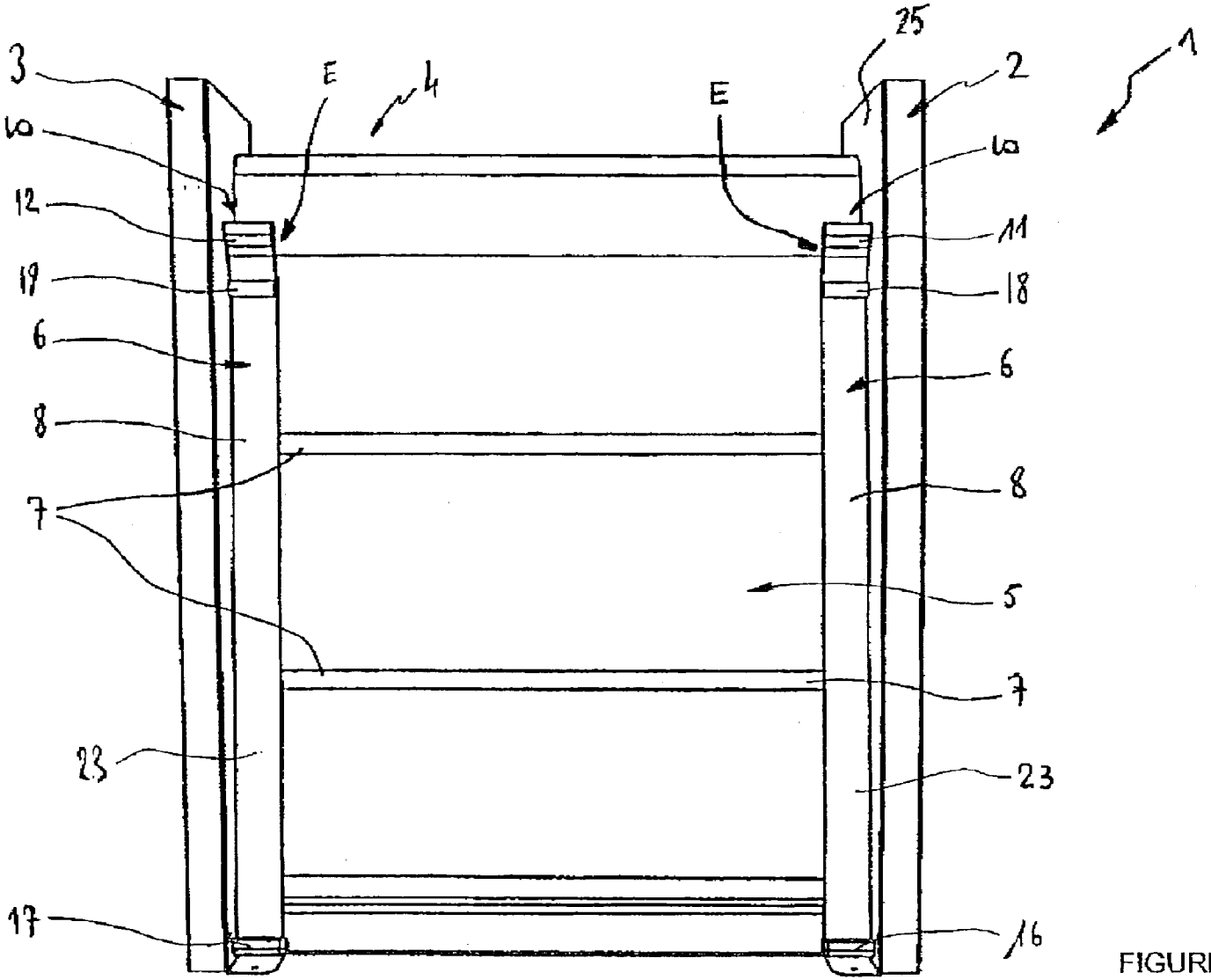
FIG. 1 is a front view showing a goods-handling door and its guidance device for the flexible roll-up curtain according to the present invention.
Figure 2:
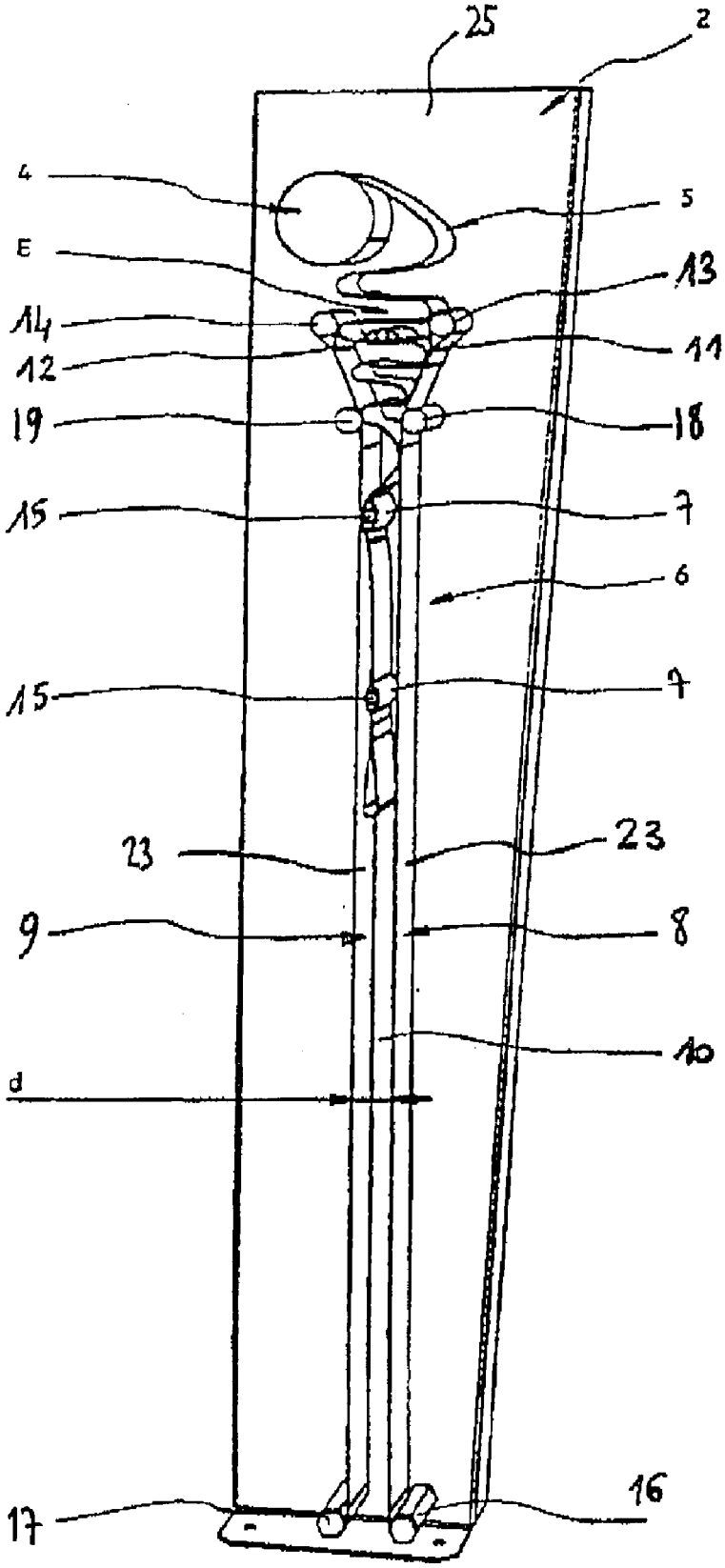
FIG. 2 is a perspective view showing a vertical jamb integral with the guidance device according to the present invention.

Shown in FIGS. 1 and 2 is a goods-handling door 1 comprising two lateral jambs 2 and 3 that are generally fixed to the vertical walls of an opening that is to be closed.

The opposing vertical jambs 2 and 3 are connected together, at the top of the goods-handling door 1, by a winding drum 4 for moving a flexible curtain 5.

The jambs 2 and 3 are integral with a device 6 for guiding the flexible curtain 5 as it moves between a closed position and an open position.

It will be observed that the flexible curtain comprises, for example, sleeves 7 into which reinforcing horizontal cross-pieces 15 are inserted, their ends being acted upon by the guidance devices 6 provided on each jamb 2 and 3.

Each guidance device 6 comprises flexible channels formed by straps 8 and 9 arranged opposite each other in order to form on each jamb 2 and 3 a guideway 10 for the curtain 5 and for its horizontal cross-pieces.

For clarity, and to assist comprehension, only the guidance device 6 provided on jamb 2 will be described, given that the other device on jamb 3 is identical (FIG. 2).

At the top of the jamb 2, the straps 8 and 9 of the guidance device 6 each have at one end a loop 11, 12, respectively, engaged on an end point formed by the holding pin 13, 14 built into the jamb 2.

Holding pins 13 and 14 are arranged opposite each other near the drum 4 which takes the curtain 5 of the door 1.

At the bottom of the jamb 2, two tensioners 16, 17 form the other end points of the guidance device 6 and take the opposite ends of the straps 8 and 9 remote from the loops 11 and 12, respectively.

The tensioners 16 and 17 are both set at the same level and may have for example an external six-sided profile so that a wrench can be used to tension each strap 8 and 9 between two end points formed by the pins 13, 14 and the tensioners 16, 17.

Between the two end points of the guidance device 6 are two opposite stops 18 and 19 against which the straps 8 and 9, respectively, bear.

The stops 18 and 19 are offset with respect to the holding pins 13 and 14 but are on the same vertical axis as the tensioners 16 and 17.

This configuration means that the straps 8 and 9 present a sloping part to create an accommodation space E for the flexible curtain 5 near the drum 4.

The straps 8 and 9 present, in the continuation of the accommodation space E, a vertical straight part of constant width d, or of variable width such that said straps are parallel or inclined with respect to each other to guide the flexible curtain 5 during its vertical movements between a closed position and an open position.

Each strap 8 and 9 thus has a sloping part between the holding pins 13 and 14 and the opposing stops 18 and 19, respectively, forming the space E which is more particularly V-shaped.

Figure 3:
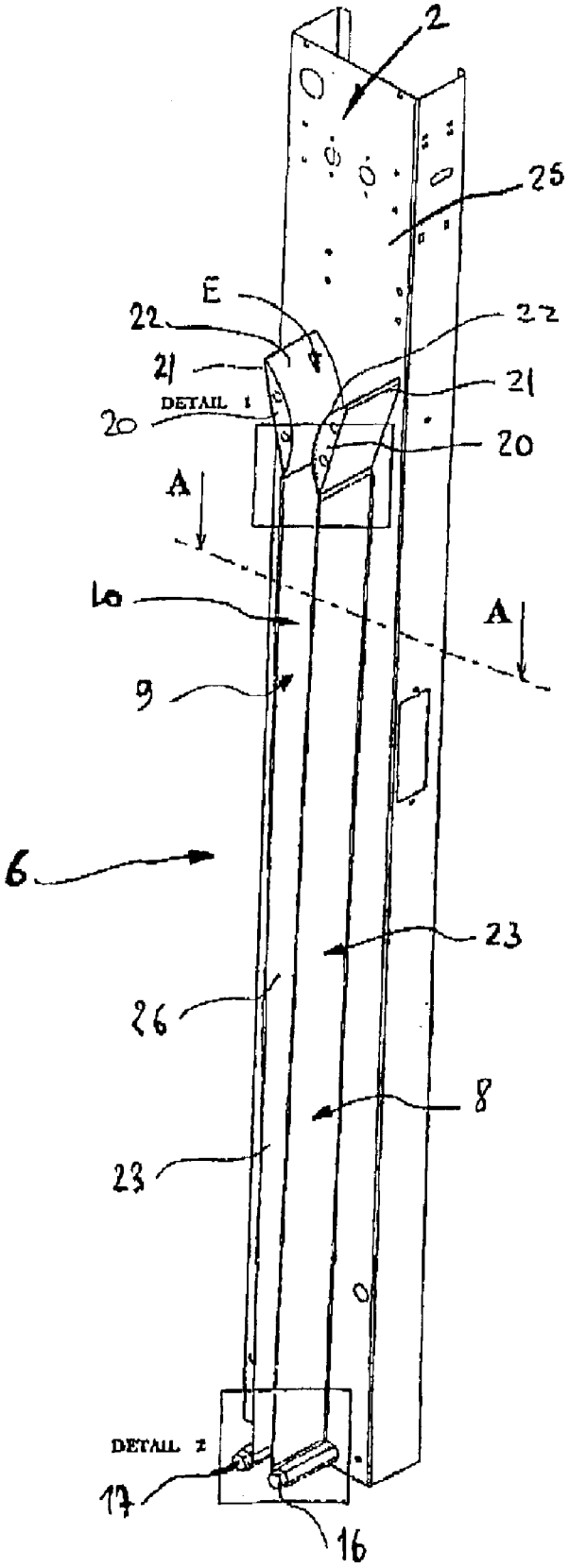
FIG. 3 is a perspective view showing a variant of the vertical jamb integral with the guidance device according to the present invention.
Figure 4:
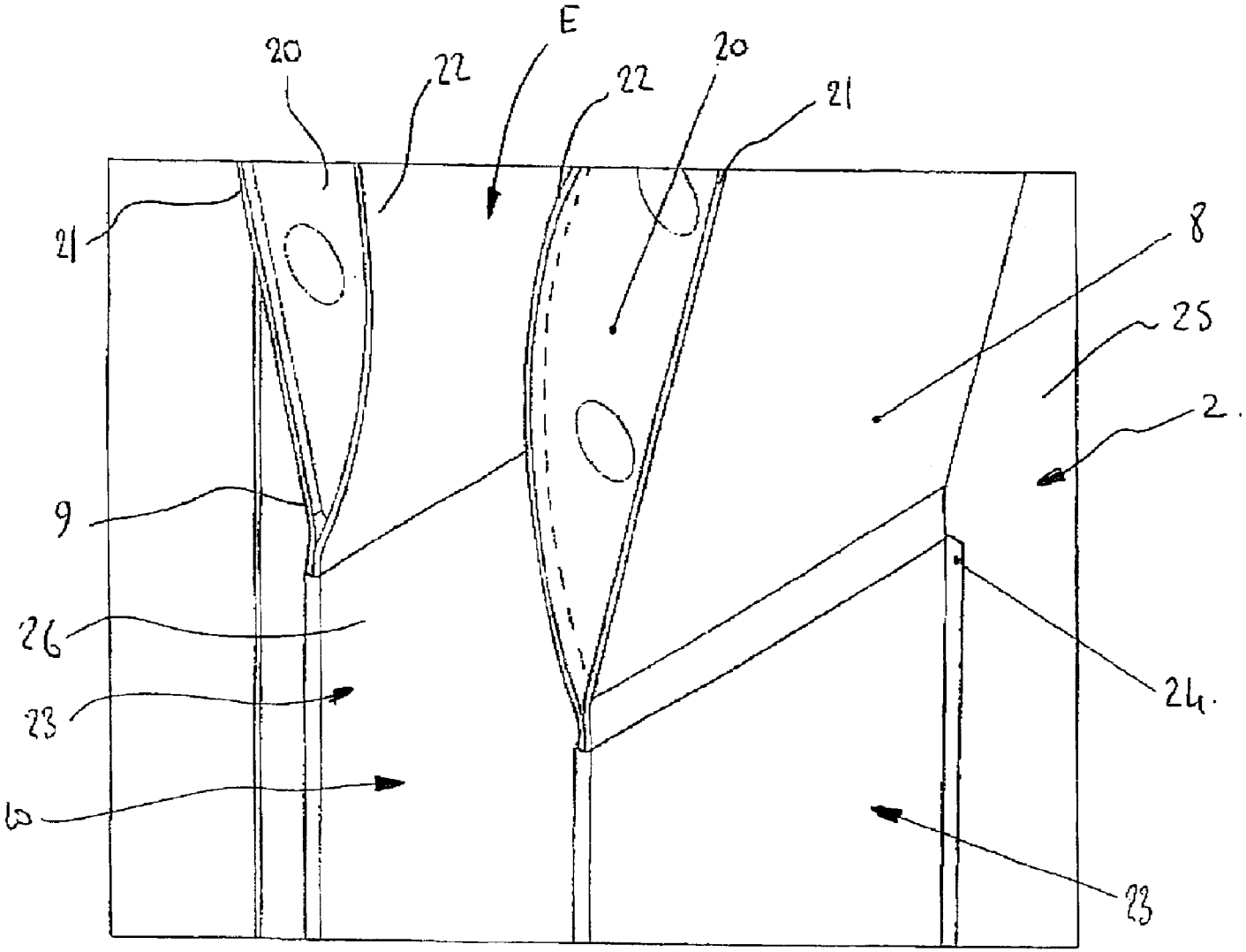
FIG. 4 is a perspective view of a detail illustrating the upper end of the vertical jamb of FIG. 3 integral with the guidance device according to the present invention.

In FIGS. 3 and 4 the straps 8 and 9 of the guidance device 6 are each shown to be retained, at the top of the jamb 2, by a support 20 which slopes so as to create the accommodation space E.

The support 20 has a flat external face 21 to which the top of the straps 8 and 9 of the guidance device 6 is fixed. The support 20 comprises, opposite the face 21, another or internal face 22 of curved profile delimiting the accommodation space E.

Figure 5:
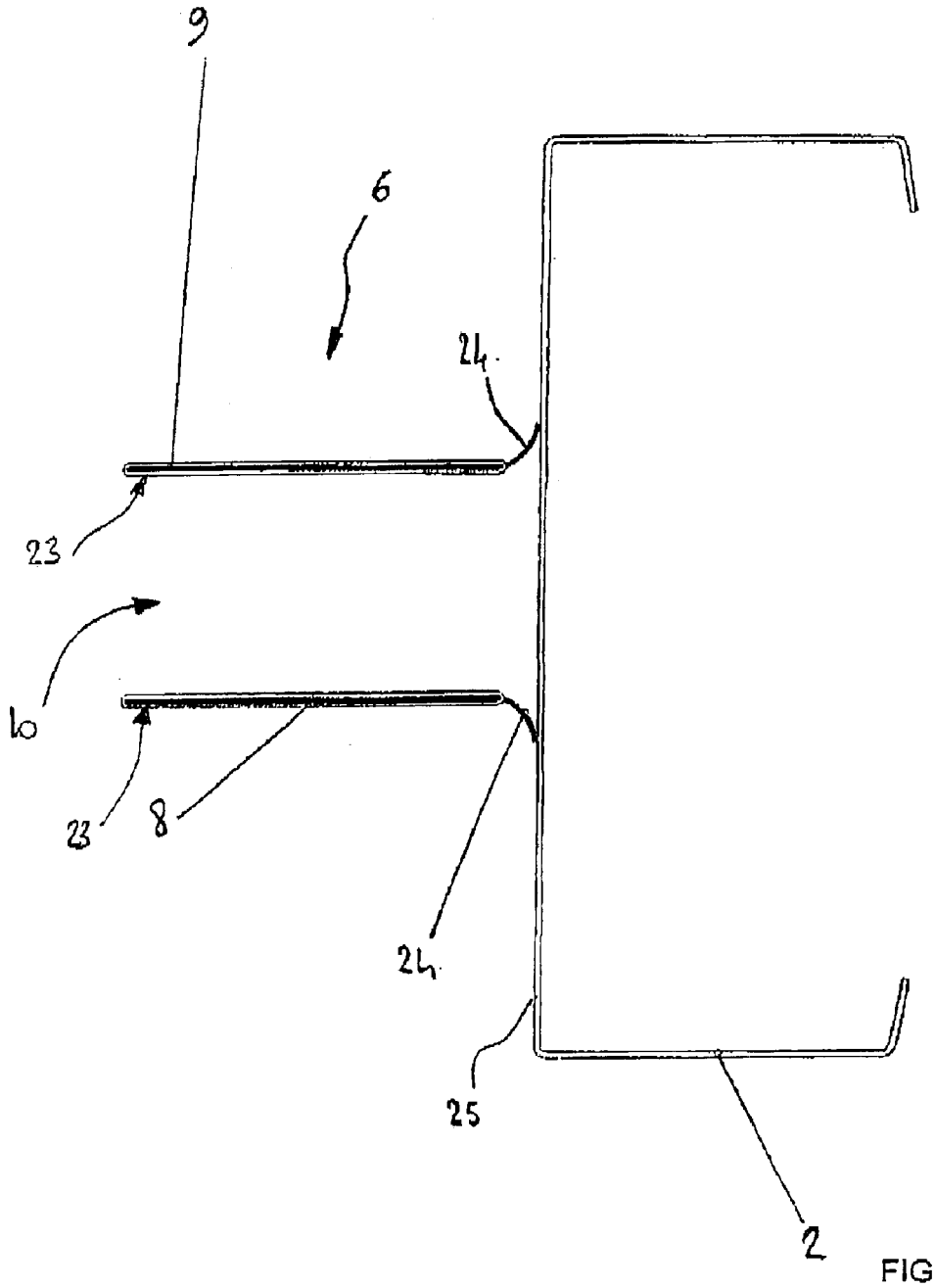
FIG. 5 is a cross section showing the vertical jamb integral with the guidance device according to the present invention.

FIG. 5 is a cross section showing the vertical jamb 2 integral with the guidance device 6 in which the straps 8 and 9 are enveloped and protected by a plastic cover 23.

The cover 23 occupies the entire height of the straps 8 and 9 between the tensioners 16, 17 and the stops 18, 19 or the support 20.

The cover 23 is integral throughout its height with a lip 24 that bears against the face 25 of the vertical jamb 2 to form a seal between the latter and the guidance device 6.

Owing to its material, the cover 23 enveloping each strap 8 and 9 of the guidance device 6 improves the movements of the curtain 5 by reducing the coefficient of friction.

Thus, when an external load is applied to the curtain by, for example, a strong wind, the cover 23 considerably improves the movements of the curtain 5 because the materials used are similar or of the same family, ensuring a good sliding action.

Similarly, the cover 23 may be made in colors different from or identical to those of the curtain 5 in order to improve the appearance of the goods-handling door.

Figure 6:
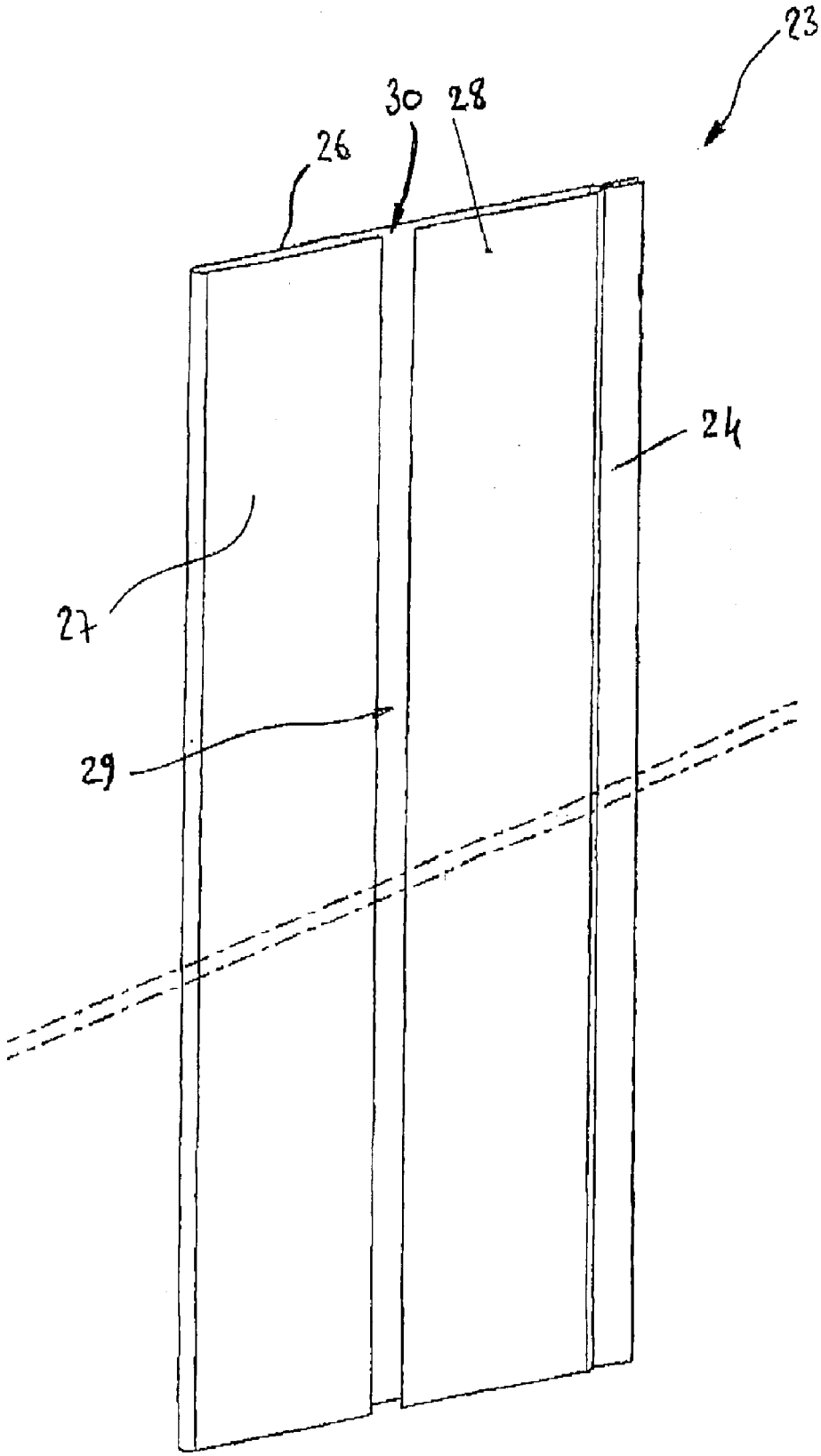
FIG. 6 is a perspective view depicting a variant of the cover for the guidance device according to the present invention.

FIG. 6 illustrates an example of an embodiment of the cover 23 enveloping the straps 8 and 9 of the guidance device 6 of the goods-handling door 1.

The cover 23 has a vertical face 26 that is continuous from top to bottom and is continued by two folded edges 27 and 28 separated by a continuous vertical slit 29.

The edges 27 and 28 are so arranged as to form the opposite face from the face 26 in order to define an internal space 30 into which the strap 8, 9 of the guidance device 6 is introduced.

The cover 23 comprises at the junction between the face 26 and the edge 28 a flexible lip 24 that may be formed by, for example, coextrusion and that bears on the face 25 of the jamb 2.

This flexible lip 24 forms a seal between the guidance device 6 and the jamb 2 when the straps 8 and 9 are enveloped by the cover 23.

The cover 23 is fitted around each strap 8 and 9 in such a way that the face 26 is on the inside of the guideway 10 of the guidance device 6, thus forming the sliding surface on which the curtain 5 bears in the course of its vertical movements.

The vertical slit 29, which is not obligatory, improves the fitting of the cover 23 around the straps 8, 9 without the cover having to be dismantled.

It should also be understood that the foregoing description has been provided purely by way of example and that it in no way limits the scope of the invention, which would not be departed from by replacing the described details of execution with any other equivalent means.

What is claimed is:

1. A guide for a curtain for a door, the guide comprising:

two longitudinally extended straps forming a flexible longitudinal channel between said two straps for receiving a curtain for a door; and a protective cover on at least one of said two straps, said protective cover having a continuous, longitudinally extended interior sliding surface facing said channel and on which a curtain in said channel slides, said protective cover having an internal space through which a respective one of said two straps is longitudinally extended.

2. The guide of claim 1, wherein said cover comprises a longitudinally extended lip that protrudes from an edge said cover, whereby said lip forms a seal with a door.

3. The guide of claim 1, wherein said cover has an exterior surface facing away from said channel, said exterior surface being formed of two folded-over flaps of said cover and having a continuous, longitudinally extended slit between said two folded-over flaps.

4. The guide of claim 3, wherein said cover further comprises a longitudinally extended lip that protrudes from an edge of said cover between said interior and exterior surfaces.

5. The guide of claim 1, wherein said cover comprises a plastic.

6. The guide of claim 1, wherein each of said two strap is covered with a respective said cover.

7. The guide of claim 1, further comprising two spaced-apart guides adjacent to one end of said two straps, each of said two straps sliding over a respective one of said two guides, and two tensioners at an opposite end of said two straps, each of said two straps being tensioned by a respective one of said two tensioners, and wherein said cover covers the respective one of said two straps from adjacent to a respective one of said guides to adjacent to a respective one of said tensioners.

8. The guide of claim 7, wherein said cover further comprises a lip that protrudes from an edge of said cover and extends longitudinally from adjacent to a respective one of said adjacent to a respective one of said tensioners.

9. The guide of claim 8, wherein said cover has an exterior surface facing away from said channel, said exterior surface being formed of two folded-over flaps of said cover and having a continuous, longitudinally extended slit between said two folded-over flaps.

* * * * *